US007162820B2

(12) United States Patent
Hess et al.

(10) Patent No.: US 7,162,820 B2
(45) Date of Patent: Jan. 16, 2007

(54) FLAME SIMULATING ASSEMBLY

(75) Inventors: Kristoffer Hess, Cambridge (CA); Kelly Stinson, Kitchener (CA)

(73) Assignee: Dimplex North America Limited, Cambridge (CA)

( * ) Notice: Subject to any disclaimer, the term of this patent is extended or adjusted under 35 U.S.C. 154(b) by 131 days.

(21) Appl. No.: 10/759,143

(22) Filed: Jan. 20, 2004

(65) Prior Publication Data

US 2004/0165383 A1 Aug. 26, 2004

(30) Foreign Application Priority Data

Jan. 20, 2003 (CA) ..... 2416741
Sep. 19, 2003 (CA) ..... 2441847

(51) Int. Cl.
*G09F 19/00* (2006.01)

(52) U.S. Cl. ..... 40/428; 472/65

(58) Field of Classification Search ..... 40/428; 472/65; 362/253, 806
See application file for complete search history.

(56) References Cited

U.S. PATENT DOCUMENTS

| | | | |
|---|---|---|---|
| 1,514,552 | A | 11/1924 | McCormick |
| 1,531,171 | A | 3/1925 | Berry et al. |
| 1,586,597 | A | 6/1926 | Berry |
| 1,719,622 | A | 7/1929 | Price |
| 1,768,284 | A | 6/1930 | Berry |
| 1,809,164 | A | 6/1931 | Gritt |
| 1,824,388 | A | 9/1931 | Birch |
| 1,827,941 | A | 10/1931 | Gross |
| 1,843,279 | A | 2/1932 | Gritt |
| 1,901,294 | A | 3/1933 | Gritt et al. |
| 2,285,535 | A | 6/1942 | Schlett |
| 2,286,246 | A | 6/1942 | Yearta |
| 2,708,114 | A | 5/1955 | Hancock |
| 2,963,807 | A | 12/1960 | Relph et al. |
| 3,119,371 | A | 1/1964 | Zuckerman |
| 3,395,475 | A | 8/1968 | Moss |
| 3,395,476 | A | 8/1968 | Moss et al. |
| 3,445,948 | A | 5/1969 | Moss et al. |
| 3,603,013 | A | 9/1971 | Reed et al. |
| 3,694,945 | A | 10/1972 | Detiker |
| 4,673,609 | A | 6/1987 | Hill |
| 4,965,707 | A | 10/1990 | Butterfield |
| 5,195,820 | A | 3/1993 | Rehberg |
| 5,525,177 | A | 6/1996 | Ross |
| 5,648,827 | A | 7/1997 | Shaw |
| 5,743,038 | A | 4/1998 | Soto |
| 5,787,618 | A | 8/1998 | Mullis |
| 6,050,011 | A | 4/2000 | Hess et al. |

(Continued)

FOREIGN PATENT DOCUMENTS

| | | |
|---|---|---|
| EP | 0 348 137 | 12/1989 |

(Continued)

*Primary Examiner*—Gary C. Hoge

(57) ABSTRACT

A flame simulating assembly for providing an image of flames. The flame simulating assembly has a light source for producing the image of flames, a screen, and a simulated interior fireplace wall positioned behind the screen. The screen has a front surface and is positioned in a path of light from the light source. The screen is adapted to transmit the image of flames through the front surface. The front surface of the screen includes an observation region, which is adapted to permit observation of part of the simulated interior fireplace wall.

28 Claims, 16 Drawing Sheets

U.S. PATENT DOCUMENTS

| | | | | |
|---|---|---|---|---|
| 6,269,567 | B1 * | 8/2001 | MacPherson et al. | 40/428 |
| 6,302,555 | B1 | 10/2001 | Bristow | |
| 6,363,636 | B1 | 4/2002 | Hess et al. | |
| 6,393,207 | B1 | 5/2002 | Martin et al. | |
| 6,413,079 | B1 | 7/2002 | Lyons et al. | |
| 6,461,011 | B1 | 10/2002 | Harrison | |
| 6,564,485 | B1 * | 5/2003 | Hess | 40/428 |
| 6,691,440 | B1 | 2/2004 | Petz et al. | |
| 6,757,487 | B1 * | 6/2004 | Martin et al. | 392/348 |
| 2002/0023376 | A1 * | 2/2002 | Hess | 40/428 |
| 2002/0095832 | A1 * | 7/2002 | Hess et al. | 40/428 |
| 2002/0139021 | A1 * | 10/2002 | Hess et al. | 40/428 |
| 2002/0168182 | A1 | 11/2002 | Martin et al. | |
| 2002/0170215 | A1 | 11/2002 | Mix et al. | |
| 2002/0175215 | A1 | 11/2002 | Webster et al. | |
| 2003/0046837 | A1 * | 3/2003 | Hess | 40/428 |
| 2003/0072565 | A1 | 4/2003 | Ravnbo-West et al. | |
| 2003/0126775 | A1 | 7/2003 | Corry et al. | |
| 2004/0060213 | A1 * | 4/2004 | Schroeter et al. | 40/428 |
| 2004/0181983 | A1 * | 9/2004 | Hess et al. | 40/428 |
| 2005/0063685 | A1 | 3/2005 | Bristow | |
| 2005/0086841 | A1 * | 4/2005 | Schroeter et al. | 40/428 |
| 2005/0097792 | A1 | 5/2005 | Naden | |
| 2005/0097793 | A1 * | 5/2005 | Hess | 40/428 |
| 2005/0252051 | A1 | 11/2005 | Chen | |

FOREIGN PATENT DOCUMENTS

| | | |
|---|---|---|
| EP | 1 020 685 | 7/2000 |
| EP | 1199524 | 4/2002 |
| EP | 04 25 0277 | 2/2006 |
| GB | 272836 | 6/1927 |
| GB | 322688 | 12/1929 |
| GB | 957591 | 5/1964 |
| GB | 968568 | 9/1964 |
| GB | 975009 | 11/1964 |
| GB | 978364 | 12/1964 |
| GB | 978365 | 12/1964 |
| GB | 1 088 577 | 1/1966 |
| GB | 1 024 047 | 3/1966 |
| GB | 1 097 812 | 1/1968 |
| GB | 1 186 655 | 4/1970 |
| GB | 1 443 772 | 7/1976 |
| GB | 2 118 096 | 10/1983 |
| GB | 2 151 772 | 7/1985 |
| GB | 2 210 969 | 6/1989 |
| GB | 2 222 000 | 2/1990 |
| GB | 2 242 737 | 10/1991 |
| GB | 2 261 723 | 5/1993 |
| GB | 2 267 563 | 12/1993 |
| GB | 2 276 444 | 9/1994 |
| GB | 2 288 052 | 10/1995 |
| GB | 2 290 374 | 12/1995 |
| GB | 2 298 073 | 8/1996 |
| GB | 2 302 172 | 1/1997 |
| GB | 2 302 730 | 1/1997 |
| GB | 2 321 700 | 8/1998 |
| GB | 2 372 807 | 9/2002 |
| GB | 2 379 009 | 2/2003 |
| GB | 2 387 901 | 10/2003 |
| GB | 2 409 323 | 6/2005 |
| WO | WO 01/57447 | 8/2001 |
| WO | WO 2004/027321 | 4/2004 |
| WO | WO 2004/109189 | 12/2004 |
| WO | WO 2005/028962 | 3/2005 |

* cited by examiner

FLAME SIMULATING ASSEMBLY

FIELD OF THE INVENTION

The present invention relates to a flame simulating assembly adapted for displaying an image of flames.

BACKGROUND OF THE INVENTION

Various types of flame simulating assemblies are known. Often, a flame simulating assembly is designed to be included in an electric fireplace, to simulate a fire in a real fireplace. For example, U.S. Pat. No. 4,965,707 (Butterfield) discloses a simulated flame system for an electric fireplace in which a light source is combined with billowing ribbons to simulate flames. The effect resulting tends to resemble flames from a coal fuel source more than flames from a wood fuel source. The flames for burning wooden logs tend to be more active and extend higher above the fuel source.

Known flame simulating assemblies have certain advantages over actual fireplaces, in which a combustible fuel (usually wood or coal, or natural gas) can be burned. Among other things, electric flame simulating assemblies can be used in an interior room (such as in a condominium building or a hotel) from which access to a chimney (i.e., for an actual fireplace) would be difficult. Also, and in particular, known flame simulating assemblies usually occupy less space than actual fireplaces.

The relatively narrow configurations of known flame simulating assemblies is one of their advantages, as noted above. However, known flame simulating assemblies typically have somewhat less depth (i.e., distance from front to back) than ordinary fireplaces. Due to this, the overall effect presented by these flame simulating assemblies is often not as realistic as may be desirable. This is because the relatively smaller depth of the typical flame simulating assembly, as compared to the usual depth of a real fireplace, tends to undermine the overall simulation effect sought with the typical flame simulating assembly.

There is therefore a need for an improved flame simulating assembly adapted for displaying an image of flames.

SUMMARY OF THE INVENTION

In a broad aspect of the present invention, there is provided a flame simulating assembly for providing an image of flames. The flame simulating assembly has a light source for producing the image of flames, a screen, and a simulated interior fireplace wall positioned behind the screen. The screen has a front surface and is positioned in a path of light from the light source. The screen is adapted to transmit the image of flames through the front surface. The front surface of the screen includes an observation region, which is adapted to permit observation of part of the simulated interior fireplace wall.

In yet another of its aspects, the front surface of the screen includes a viewing region disposed proximate to the simulated fuel bed, an observation region disposed distal to the simulated fuel bed so that at least part of said at least one simulated interior fireplace wall is observable through the observation region, and a transition region disposed between the viewing region and the observation region. Part of the simulated interior fireplace wall is at least partially observable through the transition region, and the image of flames is partially transmittable through the transition region. The viewing region, the transition region and the observation region are produced by the steps of providing a source of vaporized metal adapted for spraying vaporized metal onto the front surface, providing a mask element configured to substantially block vaporized metal sprayed from the source from condensing upon the observation region of the front surface, positioning the mask element in a predetermined mask position relative to the source and the front surface of the screen, positioning the source in a predetermined source position relative to the mask element and the front surface, so that vaporized metal is sprayable from the source onto the viewing region and the transition region of the front surface, spraying vaporized metal from the source onto the front surface, and permitting the metal sprayed onto the front surface to condense thereon in the viewing and transition regions.

BRIEF DESCRIPTION OF THE DRAWINGS

The invention will be better understood with reference to the drawings, in which.

DETAILED DESCRIPTION OF THE PREFERRED EMBODIMENT(S)

Figure 1:
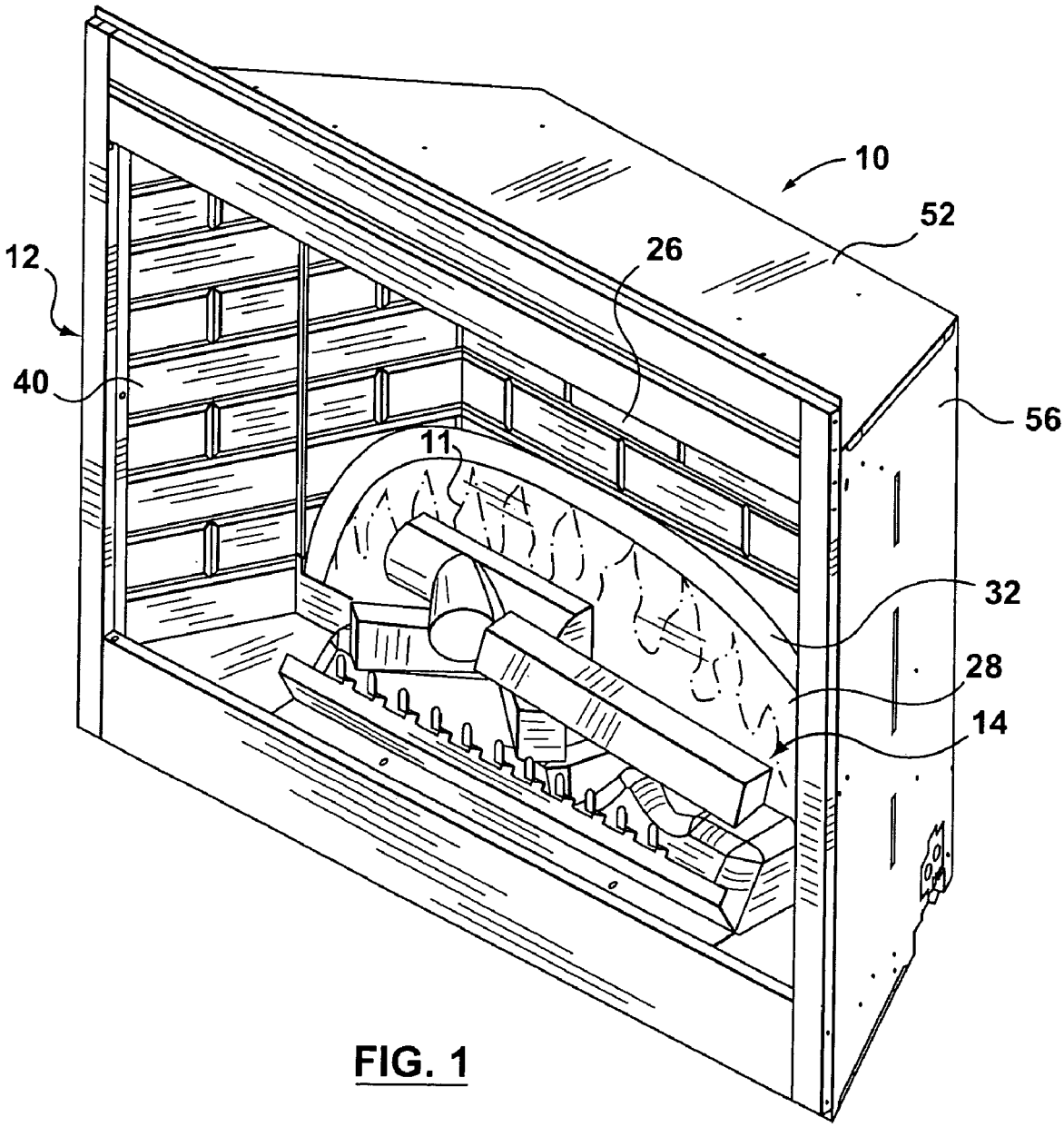
FIG. 1 is an isometric view of a preferred embodiment of the flame simulating assembly including a simulated fuel bed and a screen positioned behind the simulated fuel bed.
Figure 2A:
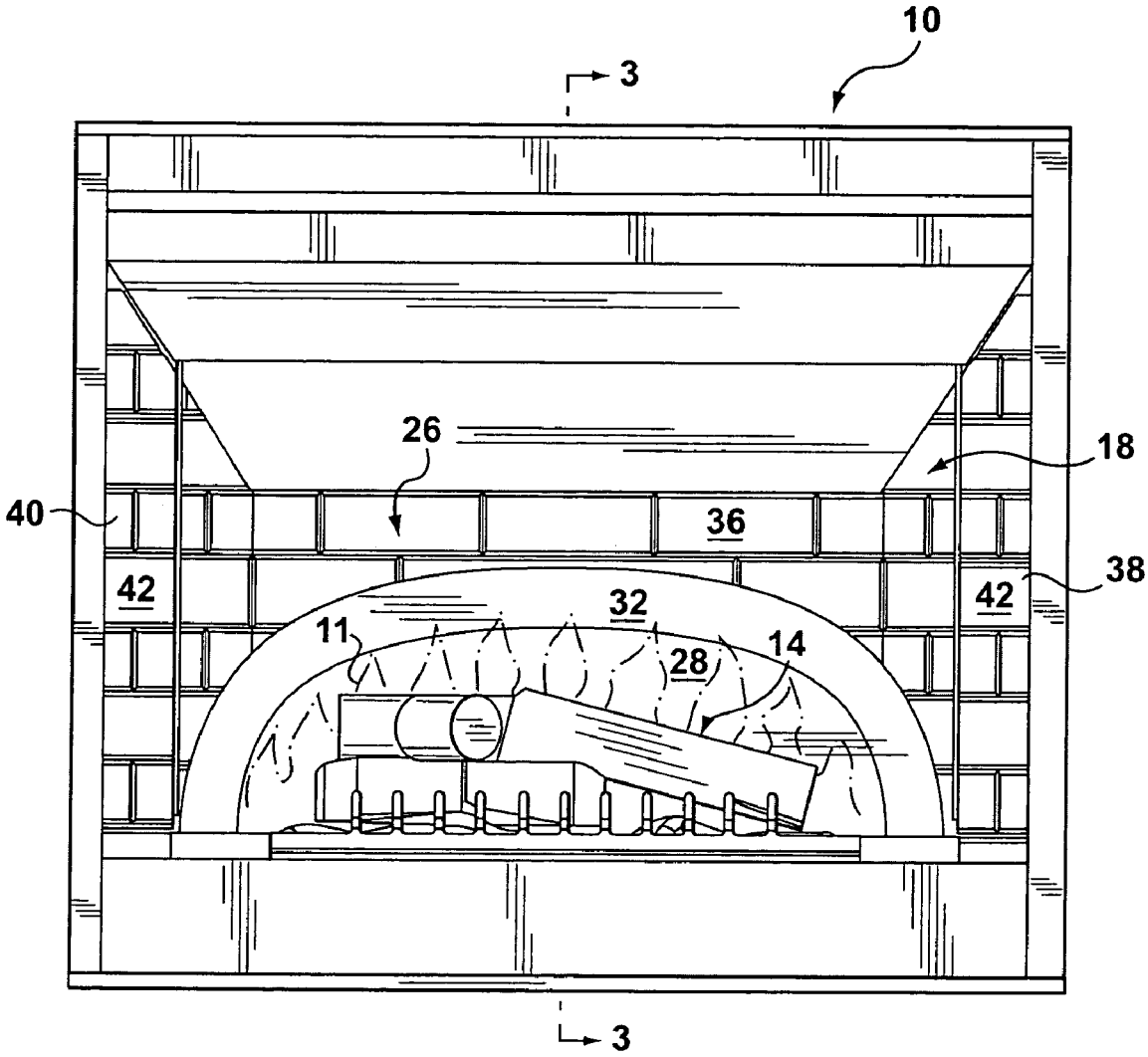
FIG. 2A is a front view of the flame simulating assembly of FIG. 1.
Figure 2B:
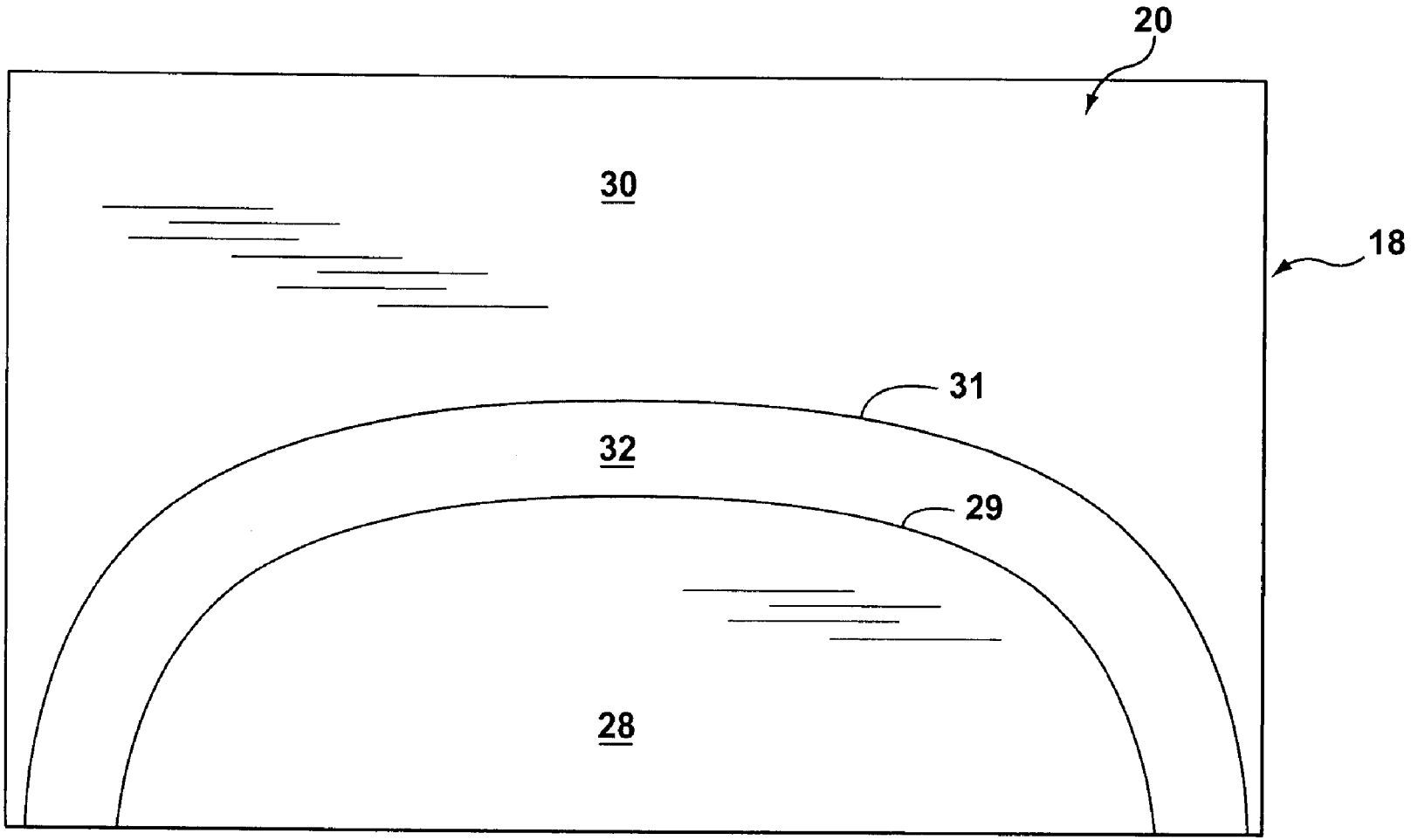
FIG. 2B is a front view of the screen.
Figure 2C:
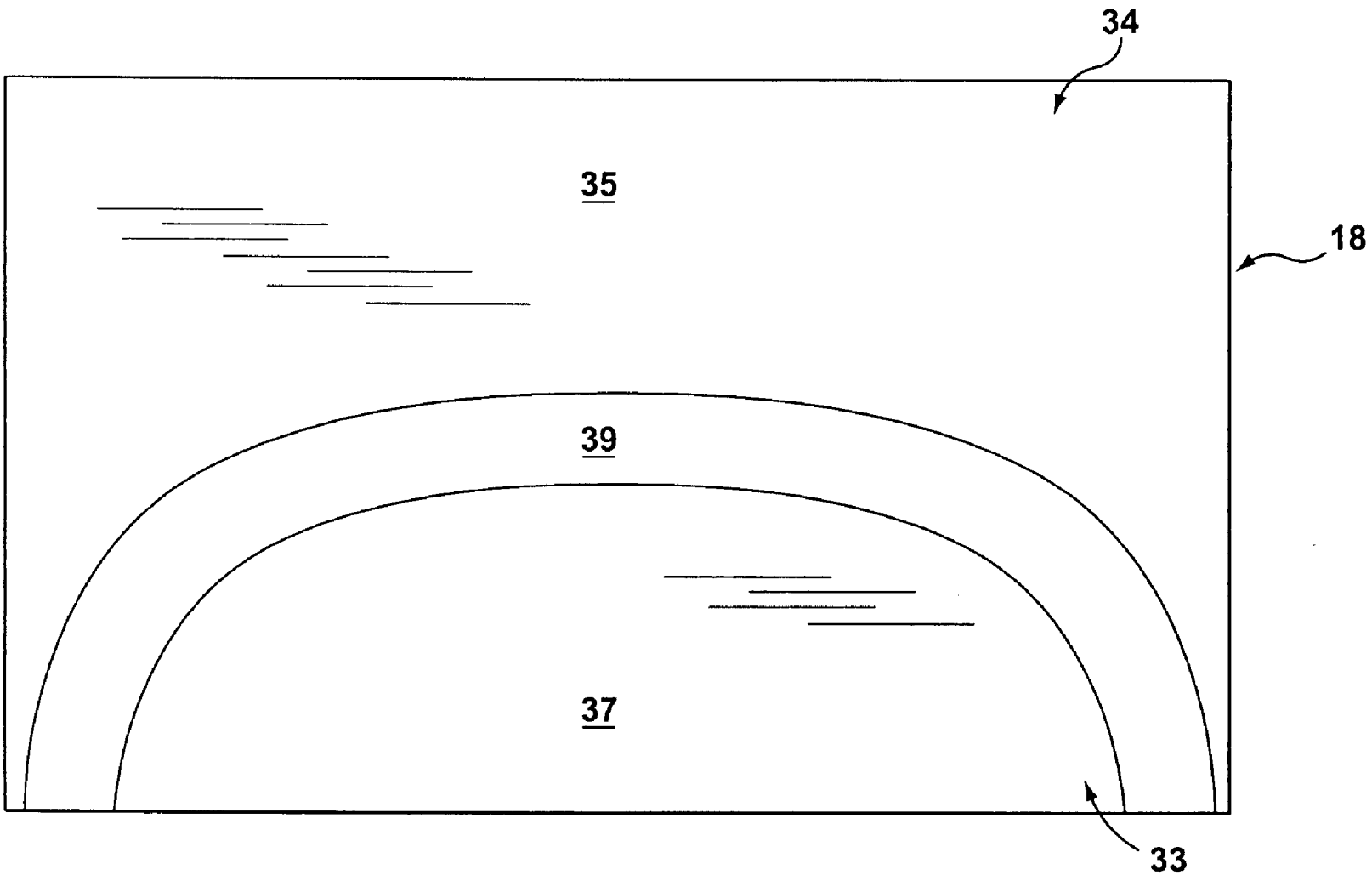
FIG. 2C is a back view of the screen.
Figure 3A:
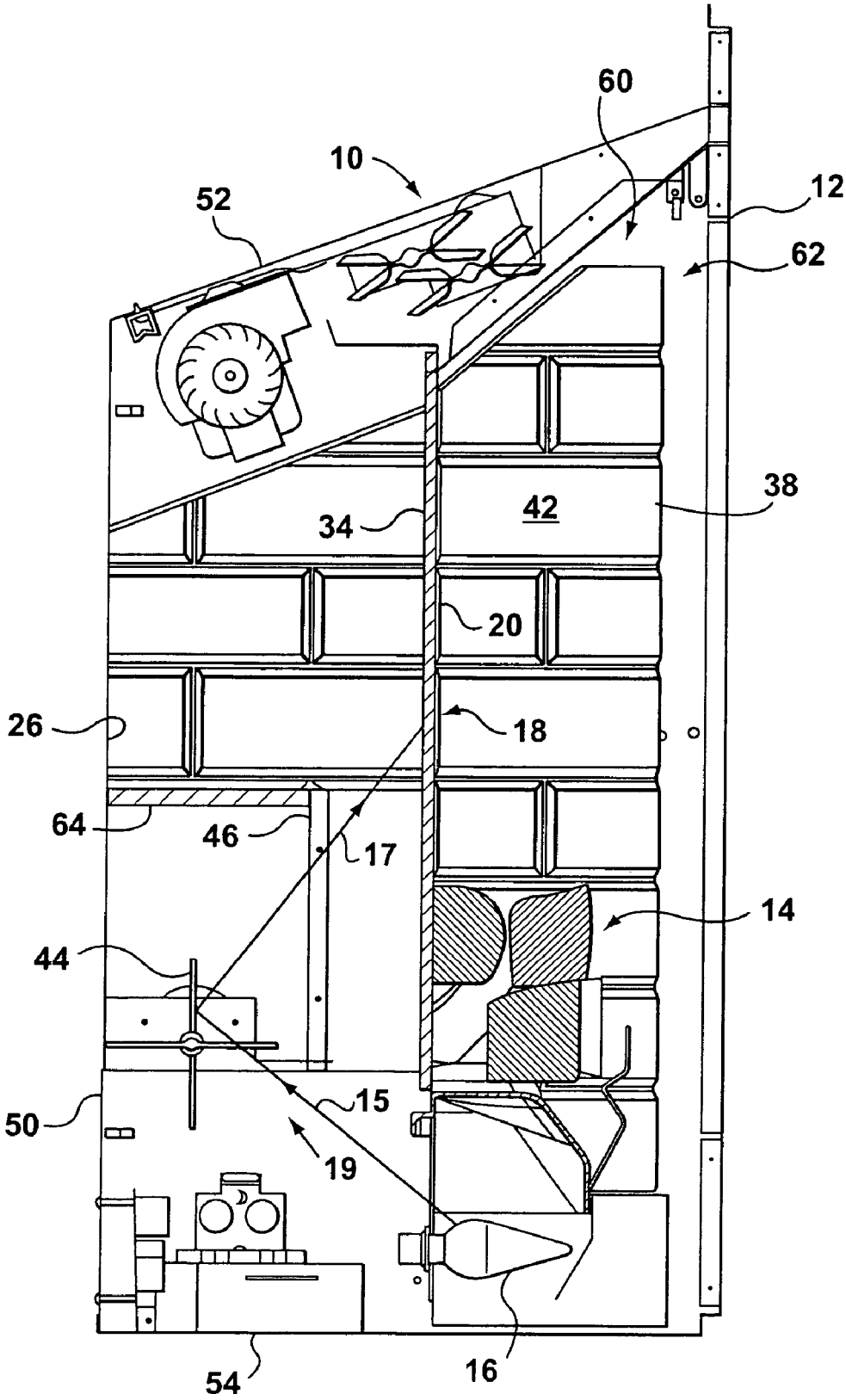
FIG. 3A is a cross section of the flame simulating assembly of FIG. 1 taken along line 3—3 in FIG. 2A, drawn at a larger scale.

Reference is first made to FIGS. 1, 2A, 2B, 2C and 3A to describe a preferred embodiment of a flame simulating assembly indicated generally by the numeral 10 in accordance with the invention. The flame simulating assembly 10 is for providing one or more images of flames 11 (FIGS. 1, 2A). Preferably, the flame simulating assembly 10 includes one or more light sources 16 for producing the images of flames 11, and a screen 18 positioned in a path of light 19 (schematically represented by arrows 15, 17 in FIG. 3A) from the light source. As can be seen in FIG. 3A, the screen 18 has a front surface 20. The screen 18 is adapted to transmit the images of flames 11 through the front surface 20. Preferably, the flame simulating assembly 10 also includes a simulated interior fireplace wall 26 which is positioned behind the screen 18, as can be seen in FIGS. 1, 2A, and 3A. In the preferred embodiment, the front surface 20 of the screen 18 includes an observation region 30 (FIGS. 2A, 2B). The observation region 30 is adapted to permit observation of at least part of the simulated interior fireplace wall 26. The front surface 20 of the screen 18 also includes a viewing region 28 (FIGS. 1, 2A, 2B).

For clarity, an image of flames 11 is illustrated in FIGS. 1, 2A, 4, and 5 in ghost outline. It will be understood that the image of flames is constantly changing (in shape and intensity of light, and color) while the flame simulating assembly 10 is operating.

As can be seen in FIGS. 1, 2A, and 3A, the flame simulating assembly 10 preferably includes a simulated fuel bed 14 which is positioned adjacent to the viewing region 28. In the preferred embodiment, the images of flames 11 are transmitted through the front surface 20 proximal to the simulated fuel bed 14, for a realistic flame simulation effect (FIGS. 1, 2A, 3A).

Preferably, the viewing region 28 is partially reflective. Because of this, the simulated fuel bed 14 is reflected in the viewing region 28 to an extent sufficient to provide an illusion of depth, as described in U.S. Pat. No. 5,642,580. U.S. Pat. No. 5,642,580 is hereby incorporated herein by reference. However, the images of flames 11 are also transmittable through the partially reflective viewing region 28. As can be seen in FIGS. 1 and 2A, the viewing region 28 is located proximal to the simulated fuel bed 14 so that, when images of flames 11 are transmitted through the screen 18, the images of flames 11 appear to be rising from and out of the simulated fuel bed 14, similar to flames in a real fire. At the same time, the simulated interior fireplace wall 26 is observable through an observation region 30, thereby simulating a firebox in a real fireplace (not shown) in which wood or coal may be burned. The observation region 30 is preferably transparent or translucent, or at least partially transparent or translucent.

In the preferred embodiment, the front surface 20 of the screen 18 also includes a transition region 32 disposed between the viewing region 28 and the observation region 30. Preferably, the images of flames 11 are at least partially transmittable through the transition region 32, and the simulated interior fireplace wall 26 is also at least partially observable through the transition region 32. The transition region 32 is for providing a relatively gradual transition from the viewing region 28 to the observation region 30, in order to provide a more realistic overall simulation effect. Preferably, if the viewing region 28 is partially reflective, then the transition region 32 is also partially reflective, however, to a somewhat lesser extent. To achieve this, the transition region 32 is preferably less silvered relative to the viewing region 28, as will be described.

In the preferred embodiment, the screen 18 additionally includes a back surface 34 positioned opposite to the front surface 20. Preferably, the back surface 34 is adapted to diffuse light transmitted through the screen 18 to prevent an observer (not shown) from observing the light source 16, or other internal components of the flame simulating assembly 10. Such a back surface 34 is described in U.S. Pat. No. 5,642,580. In the preferred embodiment of the flame simulating assembly 10, however, the back surface 34 of the screen 18 includes a diffusing portion 33 which is located substantially opposite to the viewing region 28 and the transition region 32 (FIG. 2C). The back surface 34 also includes a non-diffusing portion 35 which is located substantially opposite to the observation region 30 (FIG. 2C).

In the preferred embodiment, the diffusing portion 33 is divided into a first part 37, located opposite to the viewing region 28, and a second part 39, located opposite to the transition region 32. Preferably, the extent to which light is diffused by the second part 39 is somewhat less than the extent to which light is diffused by the first part 37. Because of this, the simulated interior fireplace wall 26 is at least partially observable through the transition region 32.

Preferably, the screen 18 is glass, plastic, or another other suitable material. In the preferred embodiment, the screen 18 is lightly silvered so that it is partially reflective, to provide a two-way mirror in the viewing region 28. The transition region 32 is preferably more lightly silvered. Within the transition region 32, the extent of reflective material on the front surface 20 varies from a relatively greater amount closer to the viewing region 28 to a relatively lesser amount closer to the observation region 30. This variation within the transition region 32 is for providing a gradual decrease in reflective material, from the viewing region 28 to the observation region 30, to enhance the simulation effect provided by the flame simulating assembly 10. The preferred method of producing the viewing region 28, the observation region 30, and the transition region 32 will be described.

Alternatively, however, the screen 18 could be suitably tinted or otherwise treated in any suitable manner to provide the described simulation effect. For example, the screen could be tinted (i.e., without silvering on the front surface 20) to provide the viewing region 28 and the transition region 32, so that the viewing region 28 is darker than the transition region 32. The observation region 30 could also be tinted or screened to achieve any desired effects, but still permitting relatively unobstructed observation therethrough.

An upper edge 29 of the viewing region 28 (which is also a lower edge 29 of the transition region 32), is shown in FIG. 2B. Also, an upper edge 31 of the transition region 32 (which is also a lower edge 31 of the observation region 30) is shown in FIG. 2B. It will be understood that, in the preferred embodiment, the regions 28, 32, and 30 are not sharply distinguished from each other. The edges 29, 31 are shown as clearly distinguished lines for illustrative purposes. In the preferred embodiment, the change from the viewing region 28 to the transition region 32 is gradual, and the change from the transition region 32 to the observation region 30 is also gradual.

It is also preferred that the simulated interior fireplace wall 26 has a pattern 36 simulating firebrick thereon (FIGS. 1, 2A, 3A). The firebrick pattern 36 preferably resembles firebrick in walls of a firebox in a real fireplace, and tends to enhance the overall simulation effect.

Preferably, the flame simulating assembly 10 also includes a flame effect element 46, for configuring light from the light source 16 to form the image of flames 11. The flame effect element 46 is positioned in the path of light 19 from the light source 16 between the light source 16 and the screen 18. The flame effect element 46 can include one or more apertures (not shown) for configuring light passing through the apertures into the image of flames 11 (FIG. 3A). A similar flame effect element is described in U.S. Pat. No. 5,642,580 and in U.S. Pat. No. 6,363,636. U.S. Pat. No. 6,363,636 is hereby incorporated herein by reference.

In the preferred embodiment, the flame simulating assembly 10 also includes a flicker element 44 for causing light from the light source 16 to fluctuate, thereby enhancing the overall simulation effect. The flicker element 44 is positioned in the path of light 19 from the light source 16 between the light source 16 and the screen 18. Preferably, the flicker element 44 is similar to the flicker elements described in U.S. Pat. Nos. 5,642,580 and 6,363,636.

In the preferred embodiment, the flame simulating assembly 10 includes a housing 48 with a substantially vertical back wall 50, a top wall 52, a bottom wall 54, and at least two side walls 56, 58 extending between the top and bottom walls 52, 54, defining a cavity 60 therein. The cavity 60 has an opening 62 at a front end 12 of the housing 48, so that the cavity 60 is substantially viewable from the front by the observer. The simulated interior wall 26 is preferably proximal to the back wall 50. Preferably, the simulated fuel bed 14 is disposed in the cavity 60 proximal to the opening 62. As shown in FIG. 3A, the screen 18 is positioned behind the simulated fuel bed 14 and in front of the interior wall 26.

As can be seen in FIGS. 1, 2A and 3A, the flame simulating assembly 10 preferably also includes two simulated interior fireplace sidewalls 38, 40. Each of the simulated interior fireplace sidewalls 38, 40 extends from the simulated interior wall 26 forwardly beyond the front surface 20 of the screen 18.

In the preferred embodiment, the interior element 26 has a pattern 36 simulating firebrick in the firebox of a real fireplace thereon. Preferably, the simulated interior fireplace sidewalls 38, 40 also have patterns 42 simulating firebrick thereon. In the preferred embodiment, the patterns 42 on the simulated interior fireplace sidewalls 38, 40 are positioned to be aligned with the pattern 36 on the interior element 26.

Although the pattern 36 and the patterns 42 are simulated firebrick (FIGS. 1 and 2A), various patterns could be used on the interior element 26 and the interior sidewalls 38, 40. As will be appreciated by those skilled in the art, various patterns could be used to achieve different simulating effects.

In use, the flicker element 44 causes light from the light source 16 to fluctuate upon reflection thereof by the flicker element 44. In the preferred embodiment, light from the light source 16 reflected by the flicker element 44 and thereby caused to fluctuate, or flicker, is configured by the flame effect element 46 to form one or more images of flames 11 transmitted through the screen 18. The images of flames 11 appear to be rising from the simulated fuel bed 14, and the observer also can simultaneously observe the simulated interior fireplace wall 26. The transition region 32 provides a relatively gradual transition between the viewing region 28 and the observation region 30, to enhance the simulation effect.

Figure 10:
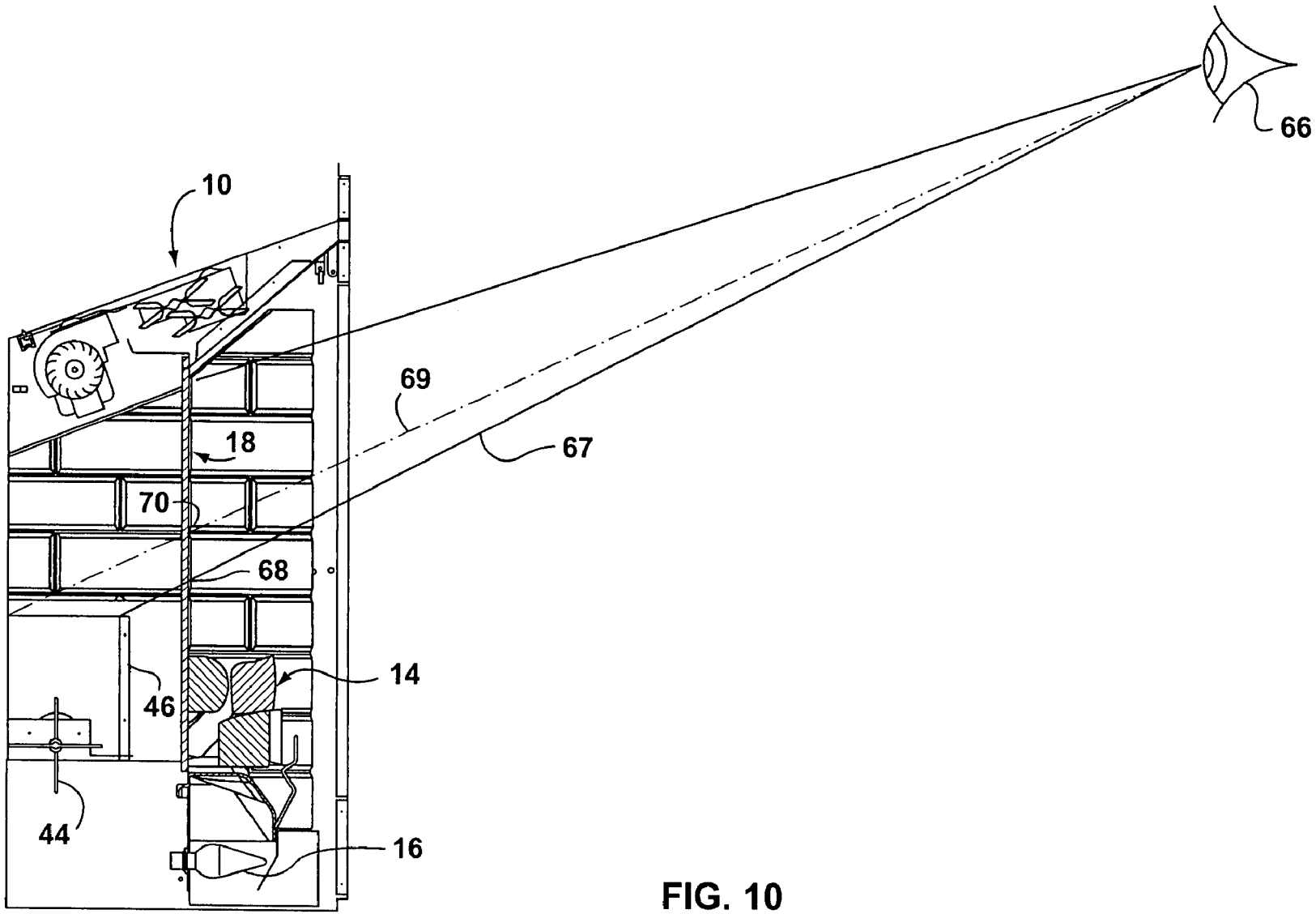
FIG. 10 is a cross section of the flame simulating assembly of FIG. 3A, drawn at a smaller scale.

Referring to FIG. 10, an eye 66 of an observer (not shown) is typically positioned so that a lower extent of the observer's field of vision (schematically represented by a line 67) intersects the screen 18 at 68. In FIG. 10, the lower edge 29 of the transition region 32 (i.e., the upper edge 29 of the viewing region 28) (FIG. 2B) is preferably located substantially at 68 on the front surface 20 of the screen 18. Similarly, an approximate middle of the observer's field of vision (schematically represented by a line 69) intersects the screen 18 at 70. In the preferred embodiment, the lower edge 31 of the observation region 30 (i.e., the upper edge 31 of the transition region 32) (FIG. 2B) is preferably located at 70 on the front surface 20 of the screen 18. The positioning of the edges 29, 31 of the regions 28, 30, 32 on the front surface 20 can be varied to suit the relative positioning of the screen 18 and the internal components in a flame simulating assembly 10, and in accordance with an assumed relative positioning (or range of positions) of the observer.

If preferred, the flame simulating assembly 10 optionally includes a shield 64, for obstructing light from the light source 16 which is directed to the vicinity of the observation region 30 or for concealing certain components. The shield 64 is preferably positioned behind the screen 18 and below the transition region 32 and beside or below the transition region 32. As can be seen in FIG. 10, an observer's eye 66 observing the flame simulating assembly 10 is typically positioned so that the observer cannot observe the flame effect element 46 or other components positioned behind the screen 18 directly. However, it is possible that an observer (not shown) could be positioned so as to view some of the internal components (such as the flicker element 44, or the flame effect element 46) directly, or light from the light source 16 directed to the observation region 30 may distract the observer. In either or both of these circumstances, it may be advantageous to include the shield 64 in the flame simulating assembly 10. A preferred embodiment of the shield 64 is shown in FIG. 3A.

However, it has been found that, if the components are positioned appropriately relative to each other and relative to the observation region 30 and the transition region 32, the shield 64 is generally not necessary. As can be seen in FIG. 10, the positioning of the flame effect element 46 and the flicker element 44 relative to the transition region 32 and the observation region 30 can affect the effectiveness of the simulation provided by the flame simulating assembly 10. The flame effect element 46 and the flicker element 44 are preferably not positioned where the ordinarily located observer would be able to observe these components directly through the transition region 32 or the observation region 30.

Additional embodiments of the invention are shown in FIGS. 3B, 4, 5, 6A, 6B, 7–9 and 11–14. In FIGS. 3B, 4, 5, 6A, 6B, 7–9 and 11–14, elements are numbered so as to correspond to like elements shown in FIGS. 1, 2A, 2B, and 3A.

Figure 4:
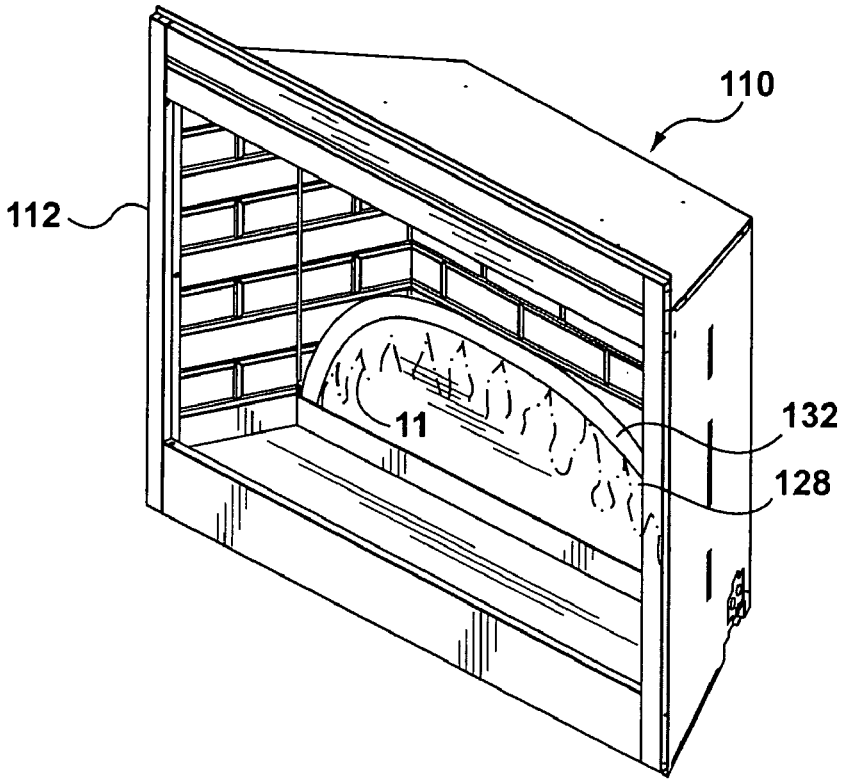
FIG. 4 is an isometric view of another embodiment of the flame simulating assembly of the invention, drawn at a smaller scale.
Figure 5:
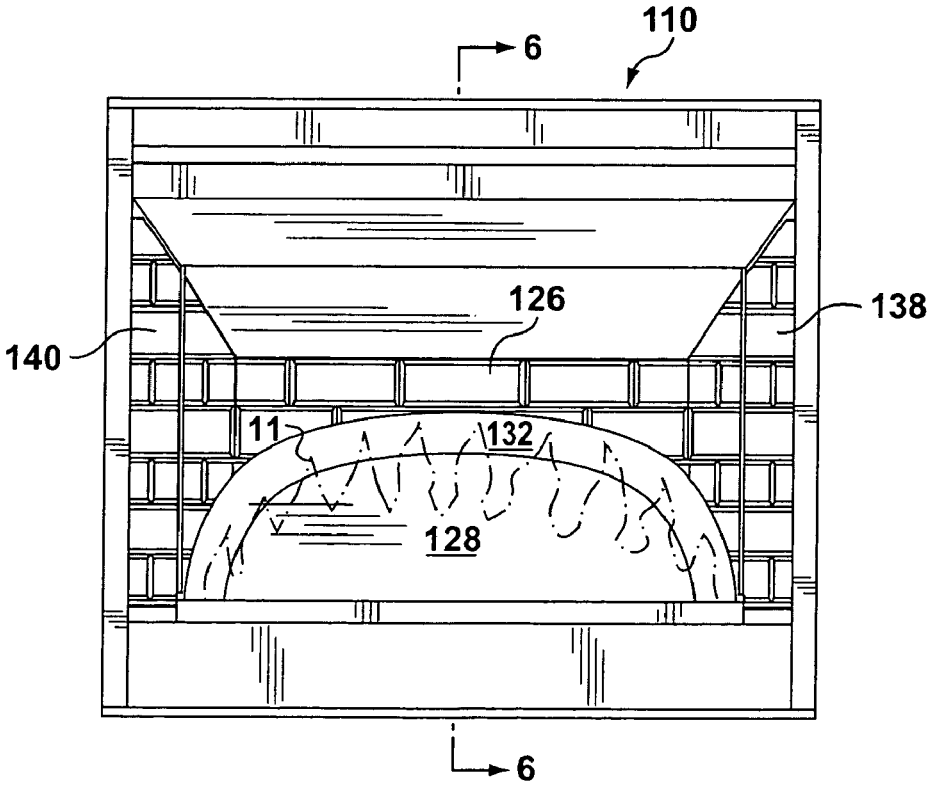
FIG. 5 is a front view of the flame simulating assembly of FIG. 4.
Figure 6A:
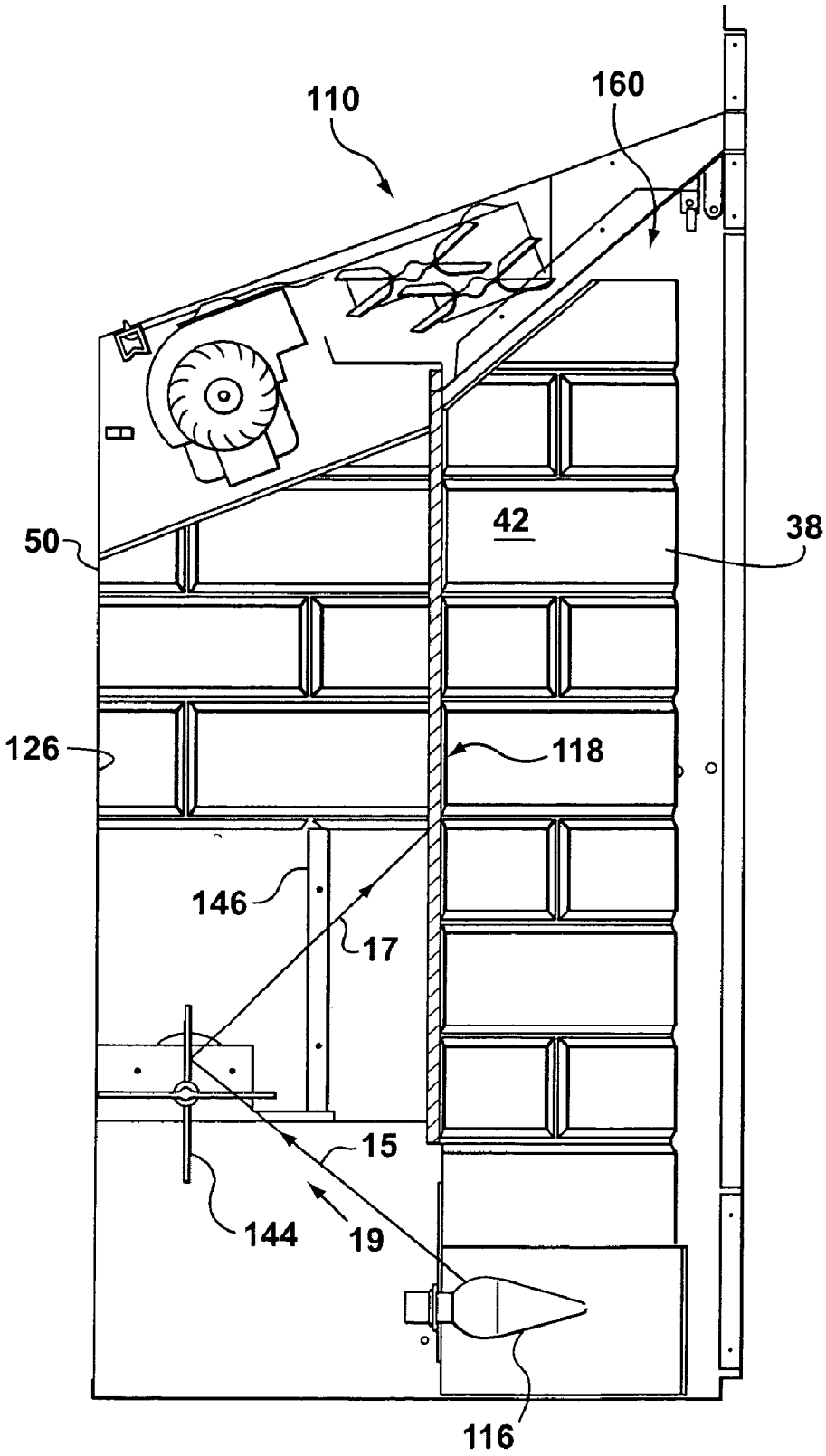
FIG. 6A is a cross section of the flame simulating assembly of FIG. 4 taken along line 6—6 in FIG. 5, drawn at a larger scale.

An alternative embodiment 110 of the flame simulating assembly is shown in FIGS. 4, 5 and 6A. The flame simulating assembly 110 does not include a simulated fuel bed, but is adapted for use with a simulated fuel bed (not shown) which is to be provided separately by a user (not shown). The simulated fuel bed, when provided, is to be located proximate to a front side 112 of the flame simulating assembly 110. The flame simulating assembly 110 includes a cavity 160, and also has a light source 116 for providing an image of flames 11 and the screen 18 positioned in the cavity 160. The flame simulating assembly 110 also includes the simulated interior fireplace wall 26 positioned behind the screen 18. The screen 18 includes the front surface 20 with the viewing region 28, the observation region 30, and the transition region 32 positioned between the viewing region 28 and the observation region 30. The viewing region 28 is positioned, at least in part, at the bottom of the screen 18—i.e., adjacent to the simulated fuel bed, once provided. The observation region 30 is positioned distal to the viewing region 28.

Because it does not include a simulated fuel bed, the flame simulating assembly 110 requires relatively less materials, and would be relatively less costly to construct. The user could use any materials chosen by the user as a simulated fuel bed. For example, real wooden logs (with or without a grate) could be used.

Although the flame simulating assembly 110 is adapted for use with a separate simulated fuel bed, the flame simulating assembly 110 also could be used without a simulated fuel bed, if the user so chose.

In the flame simulating assembly 110, the simulated interior fireplace wall 26 is preferably mounted on or positioned adjacent to the back wall 50. Also, the flame simulating assembly 110 preferably includes two simulated interior fireplace sidewalls 38, 40. Each of the simulated interior fireplace sidewalls 38, 40 extends from the simulated interior fireplace wall 26 forwardly beyond the front surface 20 of the screen 18. The simulated interior fireplace wall 26 preferably includes the pattern 36 simulating firebrick thereon. Preferably, the simulated interior fireplace sidewalls 38, 40 also have patterns 42 simulating firebrick thereon. It is preferred that the patterns 42 on the simulated interior fireplace sidewalls 38, 40 are positioned to be aligned with the pattern 36 on the back wall 26.

Figure 3B:
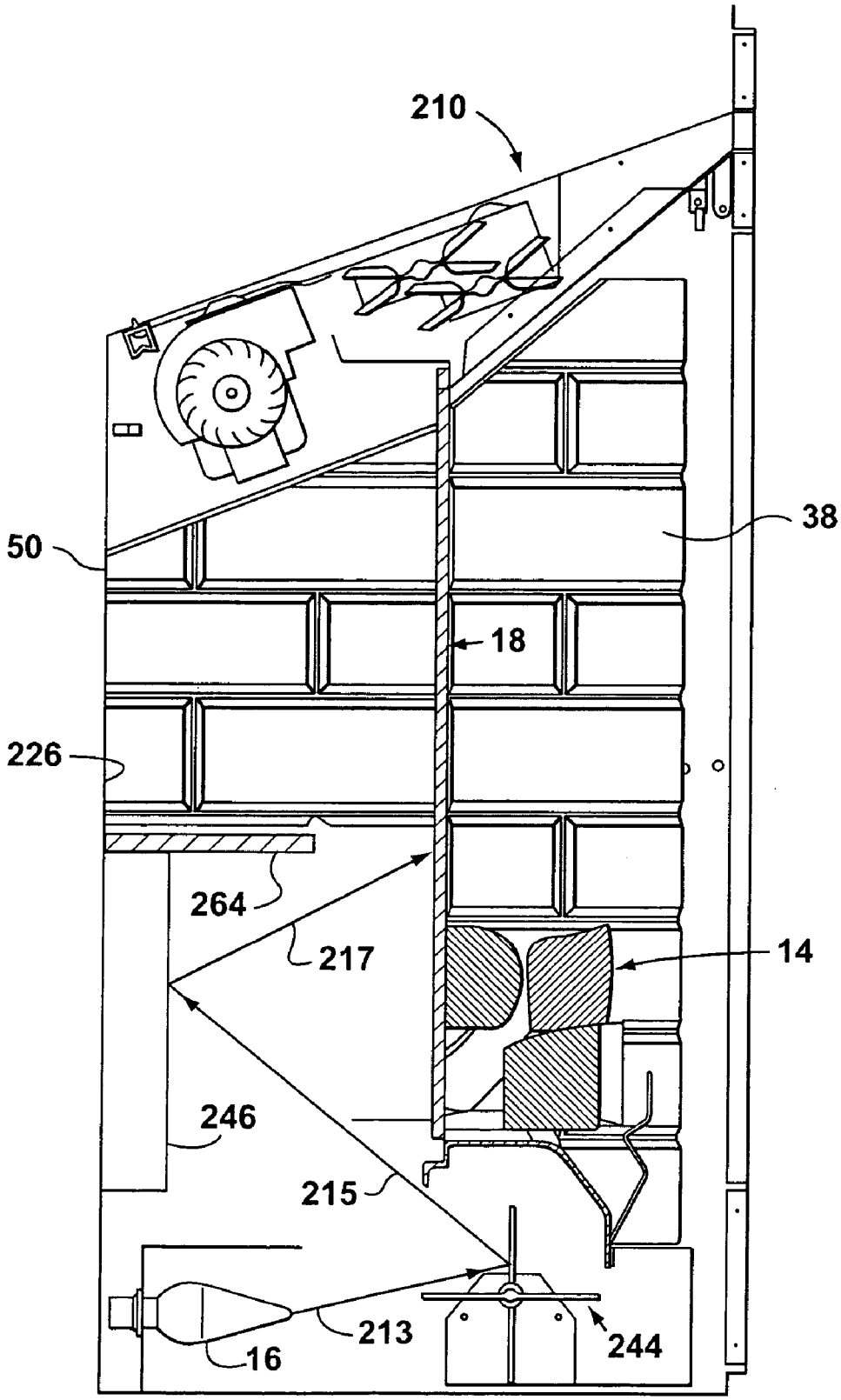
FIG. 3B is a cross section of an alternative embodiment of the flame simulating assembly of the invention.

In another alternative embodiment 210 of the flame simulating assembly of the invention, as can be seen in FIG. 3B, a flicker element 244 is positioned substantially underneath the simulated fuel bed 14. The flame simulating assembly 210 includes the housing 48, and a flame effect element 246 is mounted on or positioned proximal to the back wall 50. The flame effect element 246 is substantially reflective, and is preferably formed in the shape of flames. Preferably, the flame effect element 246 is similar to a flame effect element disclosed in U.S. Pat. No. 6,564,485. U.S. Pat. No. 6,564,485 is hereby incorporated herein by reference. Also, however, a simulated interior fireplace wall 226 is mounted proximal to the back wall 50, and in the vicinity of the flame effect element 246.

The flicker element 244 is positioned in a path of light 219 between the light source 16 and the screen 18. Similarly, the flame effect element 246 is positioned in the path of light 219 between the light source 16 and the screen 18. The path of light 219 is schematically represented by arrows 213, 215, and 217 (FIG. 3B).

The screen 18 in the flame simulating assembly 210 includes the viewing region 28, the observation region 30, and the transition region 32. The flicker element 244 causes light from the light source 16 to fluctuate upon reflection thereof by the flicker element 44. Light from the light source 16 which is reflected by the flicker element 44 and thereby caused to fluctuate, or flicker, is configured by the flame effect element 246 to form one or more images of flames 11 transmitted through the screen 18. The images of flames 11 appear to be rising from the simulated fuel bed 14, and the observer also can simultaneously observe the simulated interior fireplace wall 226. The transition region 32 provides a relatively gradual transition between the viewing region 28 and the observation region 30, to enhance the simulation effect. The positioning of the flicker element 244 substantially underneath the simulated fuel bed 14, and the positioning of the at least partially reflective flame effect element 246 proximal to, or on the back wall 50, results in an enhanced simulation effect.

Figure 11:
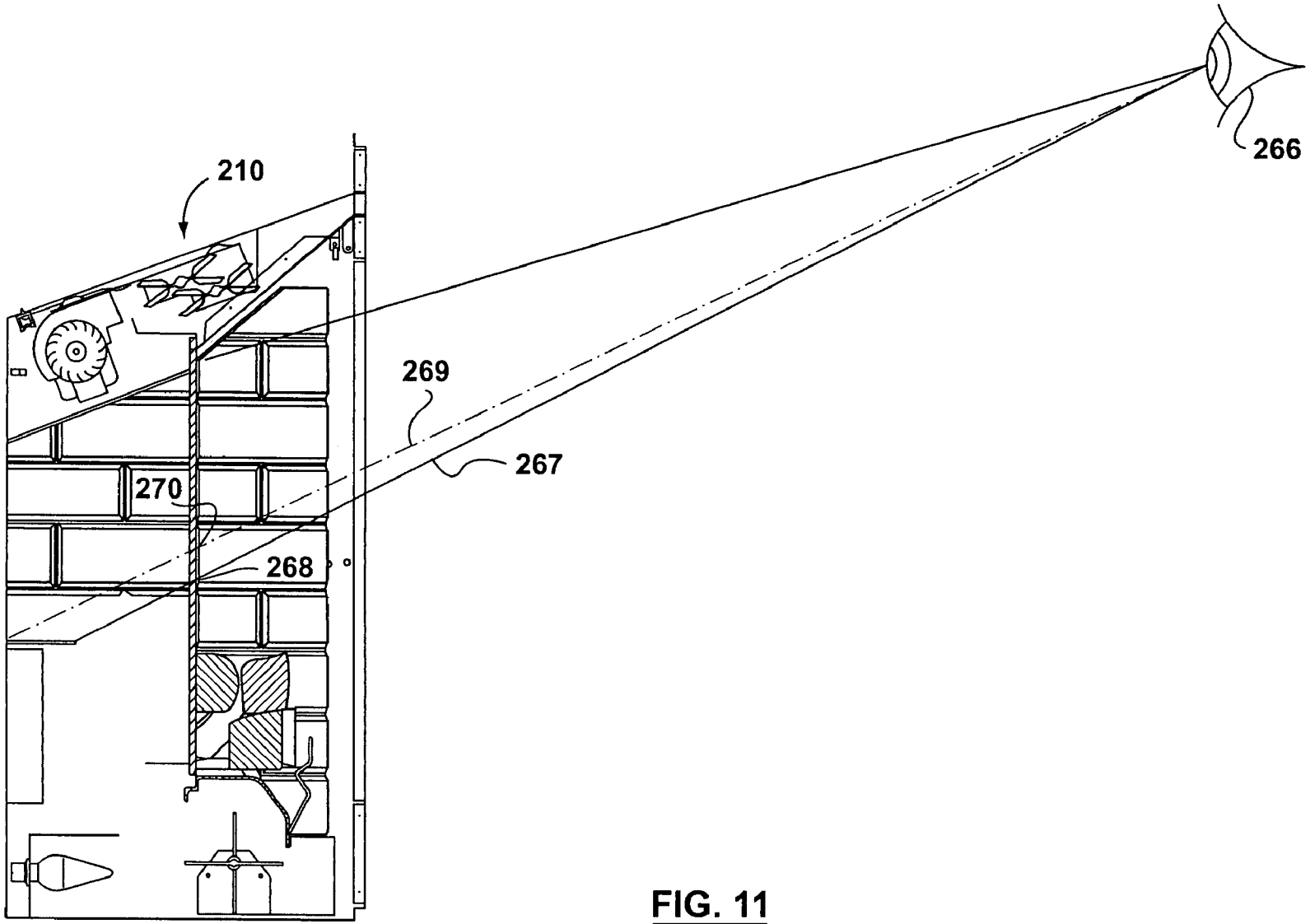
FIG. 11 is a cross section of the flame simulating assembly of FIG. 3B.

Referring to FIG. 11, an eye 266 of an observer (not shown) is typically positioned so that a lower extent of the observer's field of vision (schematically represented by a line 267) intersects the screen 18 at 268. In FIG. 11, the lower edge 29 of the transition region 32 (i.e., the upper edge 29 of the viewing region 28) (FIG. 2B) is preferably located substantially at 68 on the front surface 20 of the screen 18. Similarly, an approximate middle of the observer's field of vision (schematically represented by a line 269) intersects the screen 18 at 270. In the preferred embodiment, the lower edge 31 of the observation region 30 (i.e., the upper edge 31 of the transition region 32) (FIG. 2B) is preferably located on the front surface 20 of the screen 18. The positioning of the edges 29, 31 of the regions 28, 30, 32 on the front surface 20 can be varied to suit the relative positioning of the screen 18 and the internal components in a flame simulating assembly 210, and in accordance with an assumed relative positioning (or range of positions) of the observer.

If preferred, the flame simulating assembly 210 optionally includes a shield 264, for obstructing light from the light source 16 which is directed to the vicinity of the observation region 30 or for concealing certain components. The shield 264 is preferably positioned behind the screen 18 and beside or below the transition region 32. As can be seen in FIG. 11, an observer's eye 266 observing the flame simulating assembly 210 is typically positioned so that the observer cannot observe the flame effect element 246 or other components positioned behind the screen 18 directly. However, it is possible that an observer (not shown) could be positioned so as to view some of the internal components (such as the flicker element 244, or the flame effect element 246) directly, or light from the light source 16 directed to the observation region 30 may distract the observer. In either or both of these circumstances, it may be advantageous to include the shield 264 in the flame simulating assembly 210. A preferred embodiment of the shield 264 is shown in FIG. 3B.

However, it has been found that, if the components are positioned appropriately relative to each other and relative to the observation region 30 and the transition region 32, the shield 264 is generally not necessary. As can be seen in FIG. 11, the positioning of the flame effect element 246 and the flicker element 244 relative to the transition region 32 and the observation region 30 can affect the effectiveness of the simulation provided by the flame simulating assembly 210. The flame effect element 246 and the flicker element 244 are preferably not positioned where the ordinarily located observer would be able to observe these components directly through the transition region 32 or the observation region 30.

Figure 6B:
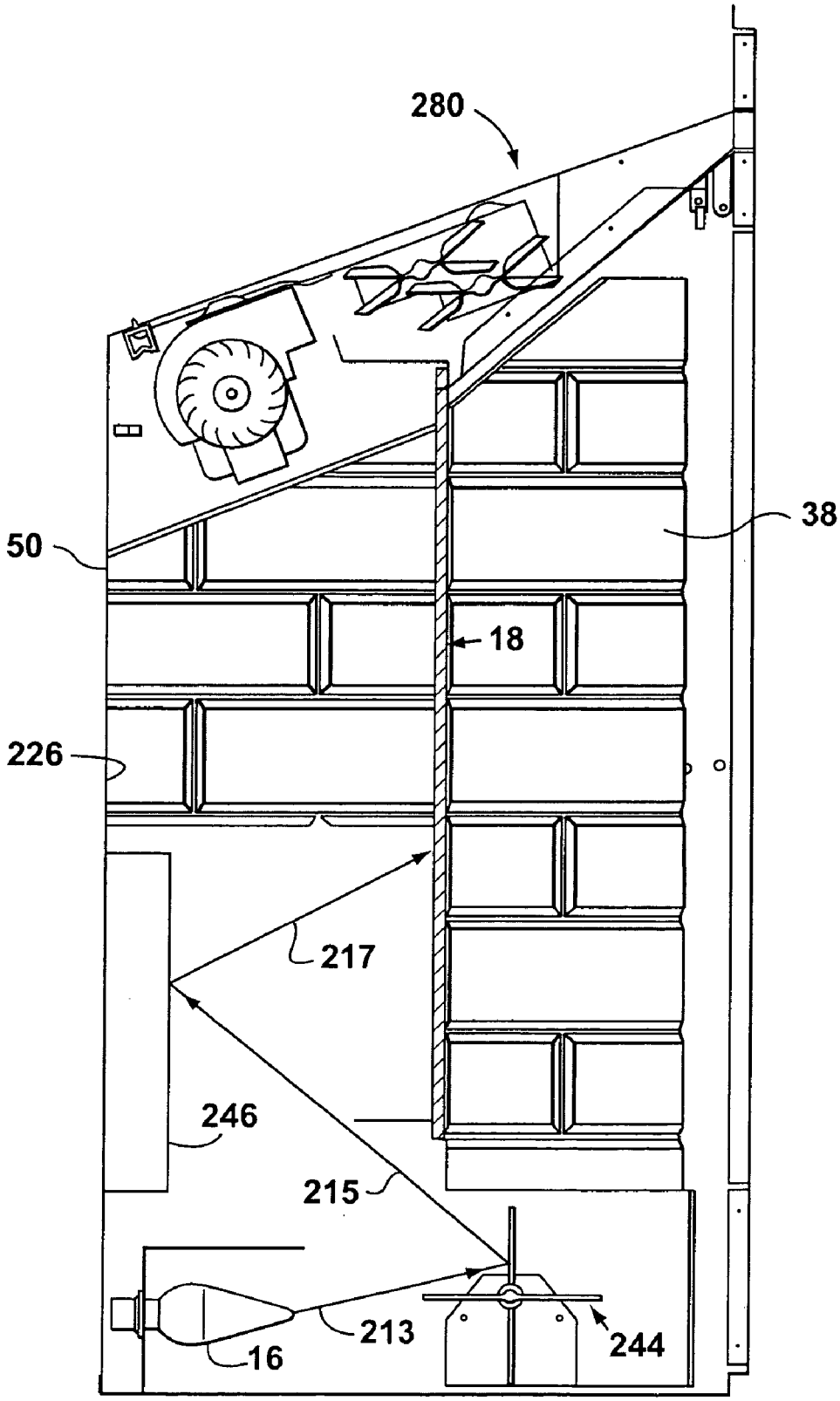
FIG. 6B is a cross section of another alternative embodiment of the flame simulating assembly of the invention.

In FIG. 6B, another alternative embodiment 280 of a flame simulating assembly of the invention is shown. The flame simulating assembly 280 is the same as the flame simulating assembly 210 shown in FIG. 3B, except that flame simulating assembly 280 does not include a simulated fuel bed. As in flame simulating assembly 110, the user can provide a simulated fuel bed or, if preferred, operate the unit without a simulated fuel bed. The flame simulating assembly 280 also is not shown as including the optional shield element.

Figure 12:
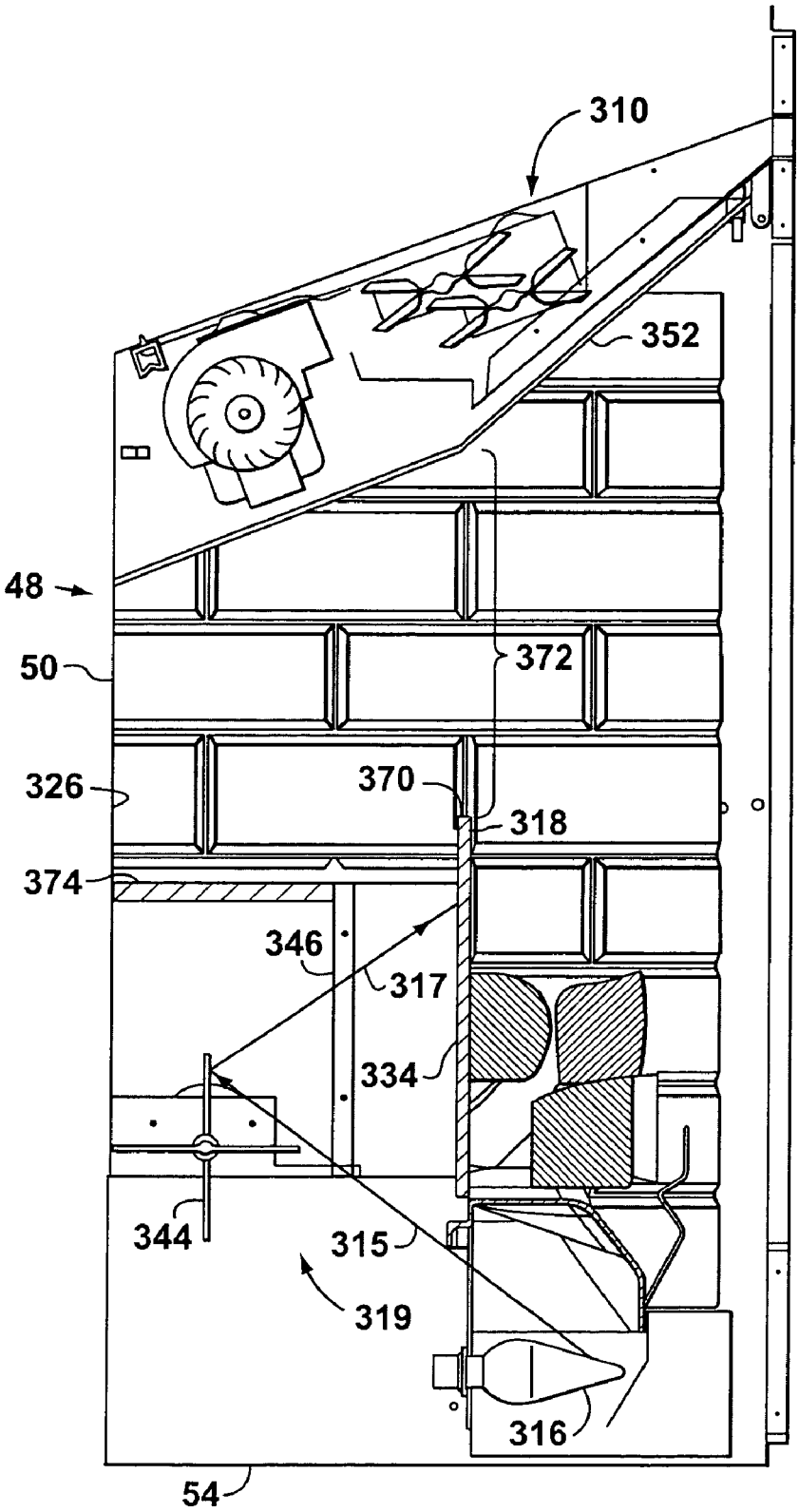
FIG. 12 is a cross section of an alternative embodiment of the flame simulating assembly including an alternative embodiment of the screen, drawn at a larger scale.
Figure 13:
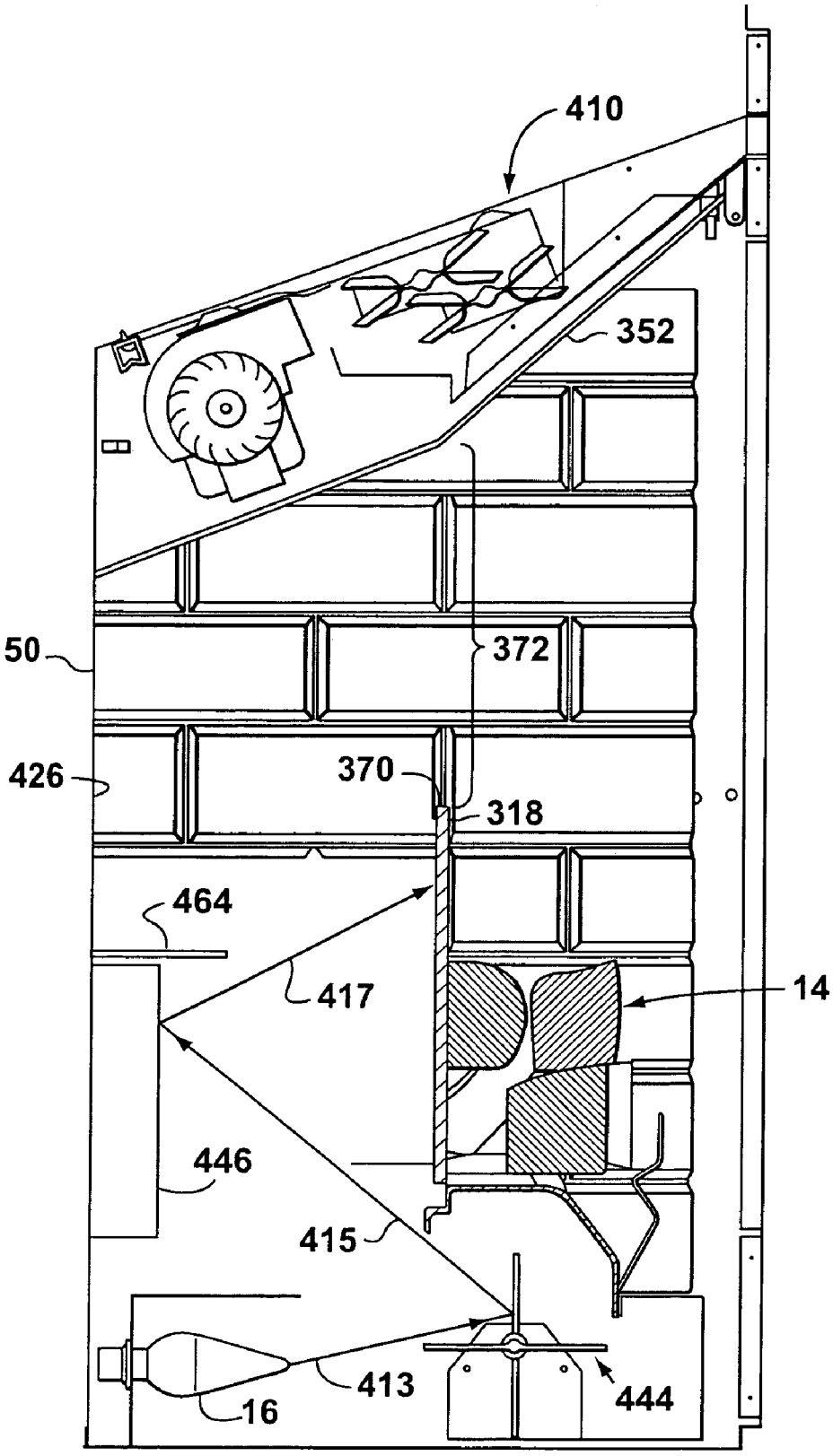
FIG. 13 is a cross section of another alternative embodiment of the flame simulating assembly including the alternative embodiment of the screen in the flame simulating assembly of FIG. 12.
Figure 14:
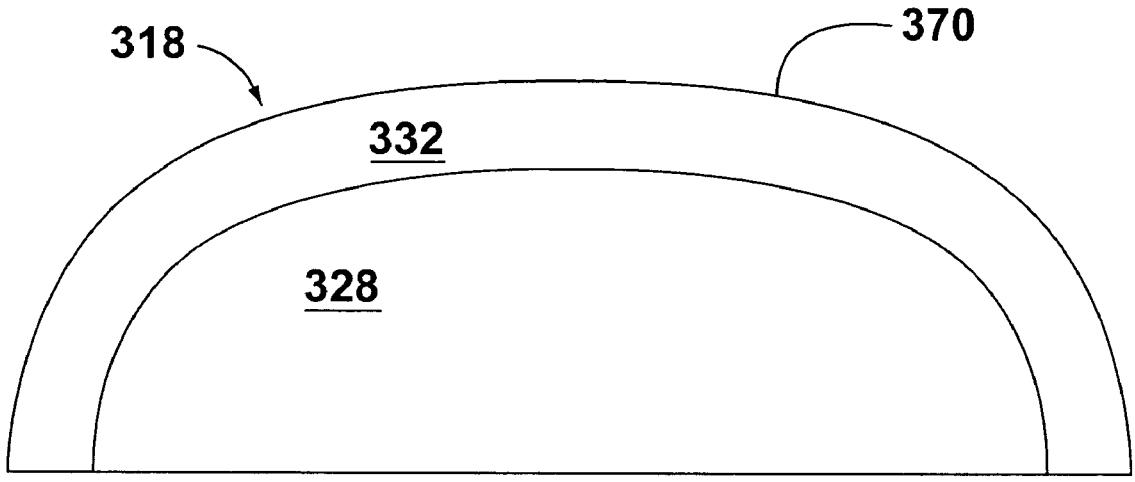
FIG. 14 is a front view of the alternative embodiment of the screen of FIGS. 12 and 13, drawn at a larger scale.

An alternative embodiment 318 of a screen is shown in FIGS. 12–14. As can be seen in FIG. 12, the screen 318 is included in an alternative embodiment of a flame simulating assembly 310. The flame simulating assembly 330 includes the housing 48, which includes the back wall 50, a top wall 352, a bottom wall 54, and at least two side walls 56, 58 extending between the top and bottom walls 352, 54. The flame simulating assembly 310 also includes a simulated interior fireplace wall 326 mounted on or positioned proximal to the back wall 50. The screen 318 is positioned behind the simulated fuel bed 14 and in front of the simulated interior fireplace wall 326.

As can be seen in FIG. 12, the flame simulating assembly 310 also includes a light source 316, a flicker element 344 positioned in a path of light 319 (schematically represented by arrows 315, 317), and a flame effect element 346, also positioned in the path of light 319. The flame effect element 346 is for configuring light from the light source 316 into one or more images of flames 11 which are transmitted through the screen 318. The flicker element 344 is for causing light from the light source to flicker or fluctuate, thereby enhancing the overall simulation effect.

As can be seen in FIGS. 12 and 14, the screen 318 extends upwardly to a top edge 370, located distal to the simulated fuel bed 14. The top edge 370 is spaced apart from the top wall 352 to form an upper opening 372 between the top wall 352 and the screen 318. Substantially unobstructed observation is thus permitted through the upper opening 372, so that the simulated interior fireplace wall 326 is observable. Because this is similar to the substantially unobstructed observation of a firebox which may be enjoyed by an observer of a real fireplace (i.e., one in which wood or coal may be burned), the upper opening 372 tends to enhance the overall simulation effect.

Optionally, a shield 374 (shown in FIG. 12) may be included in the flame simulating assembly 310. The shield 374 (similar to the shield 64, shown in FIG. 3A) is for obstructing light from the light source 16 which may be directed above the top edge 370 of the screen 318 or for concealing certain components. The shield 374 is preferably positioned behind the screen 318 and beside or below the transition region 332. It is possible that the observer could be positioned so as to view some of the internal components (such as the flicker element 344, or the flame effect element 346) directly, or light from the light source 16 directed above the top edge 370 of the screen 318 may distract the observer. In either or both of these circumstances, it may be advantageous to include the shield 374 in the flame simulating assembly 310. A preferred embodiment of the shield 374 is shown in FIG. 12.

However, it has been found that, if the internal components are positioned appropriately relative to each other and relative to the transition region 332 and the top edge 370, the shield 374 is generally not necessary. The flame effect element 346 and the flicker element 344 are preferably not positioned where the ordinarily located observer would be able to observe these components directly through the transition region 332 or the upper opening 372.

Preferably, the screen 318 includes a viewing region 328 and a transition region 332. In the preferred embodiment, the viewing region 328 is partially reflective, although the images of flames 11 are also transmittable through the viewing region 328. Also, the screen 318 preferably includes a transition region 332 extending from the viewing region 328 to the top edge 370. The transition region 332 is preferably lightly silvered (and therefore also partially reflective), so that the simulated interior fireplace wall 326 is at least partially viewable through the transition region 332. A back surface 334 of the screen 318 diffuses light from the light source 16, also to enhance the overall simulation effect. Also, however, the images of flames 11 are partially observable through the transition region 332.

Alternatively, the viewing region 332 is translucent. For example, the screen 318 could be suitably tinted glass or plastic (or other suitable material) through which the image of flames 11 is transmittable. The transition region 332 also could be suitably tinted, to enhance the overall simulation effect.

Another alternative embodiment of a flame simulating assembly 410 of the invention, shown in FIG. 13, includes the screen 318. In the flame simulating assembly 410, a flicker element 444 is positioned substantially underneath the simulated fuel bed 14. The flame simulating assembly 410 includes the housing 48, and a flame effect element 446 is mounted on or positioned proximal to the back wall 50. The flame effect element 446 is preferably reflective (or substantially reflective), and is preferably formed in the shape of flames. Preferably, the flame effect element 446 is similar to a flame effect element disclosed in U.S. Pat. No. 6,564,485. Also, however, a simulated interior fireplace wall 426 is mounted proximal to the back wall 50, and in the vicinity of the flame effect element 446.

The flicker element 444 is positioned in a path of light 419 between the light source 16 and the screen 318. Also, the flame effect element 446 is positioned in the path of light 419 between the light source 16 and the screen 318. The path of light 419 is schematically represented by arrows 413, 415, and 417 (FIG. 13).

The positioning of the flicker element 444 substantially underneath the simulated fuel bed 14, and the positioning of the flame effect element 446 proximal to or on the back wall 50, results in an enhanced simulation effect. Preferably, the flame simulating assembly 410 includes a shield 464 for obstructing light from the light source directed above the screen 318.

Figure 7:
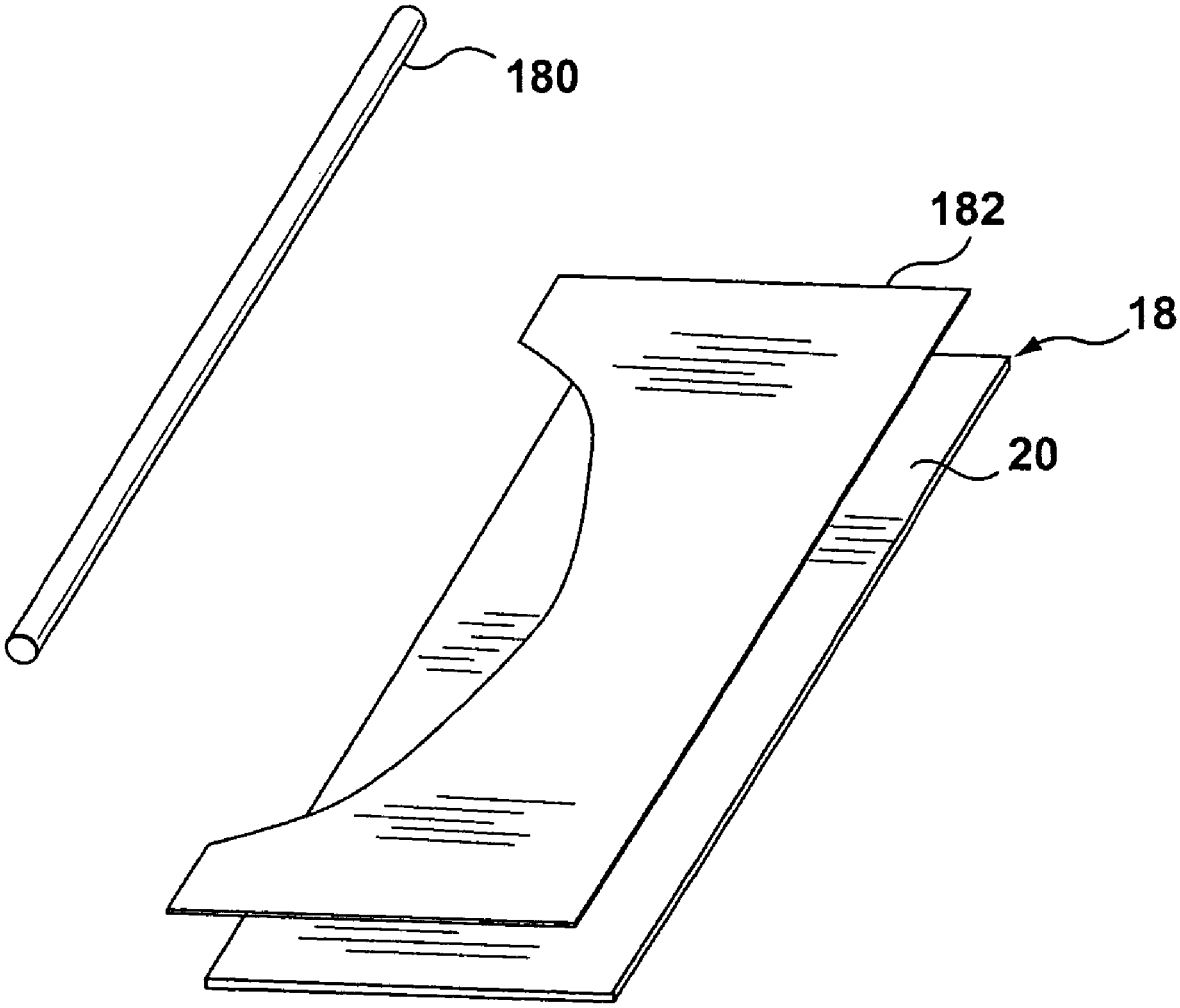
FIG. 7 is an isometric view of a screen having a front surface, with a mask element and a source of vaporized metal positioned relative to each other and to the front surface.
Figure 8:
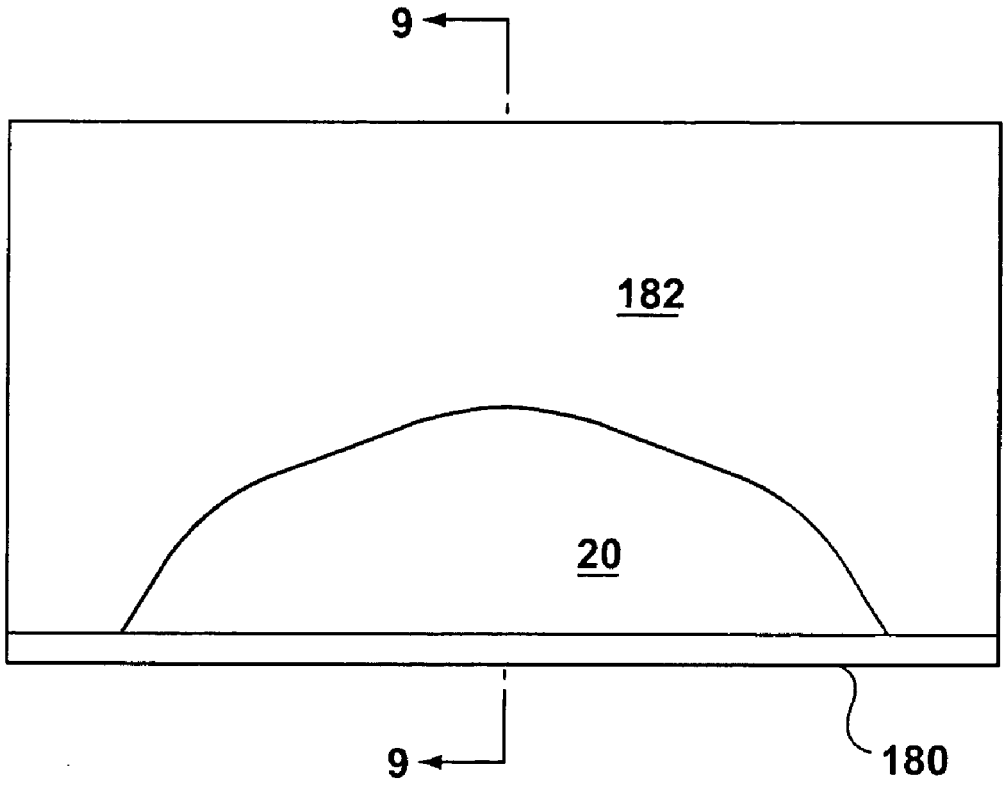
FIG. 8 is a front view of the screen, the mask element, and the source of FIG. 7, drawn at a larger scale.
Figure 9:
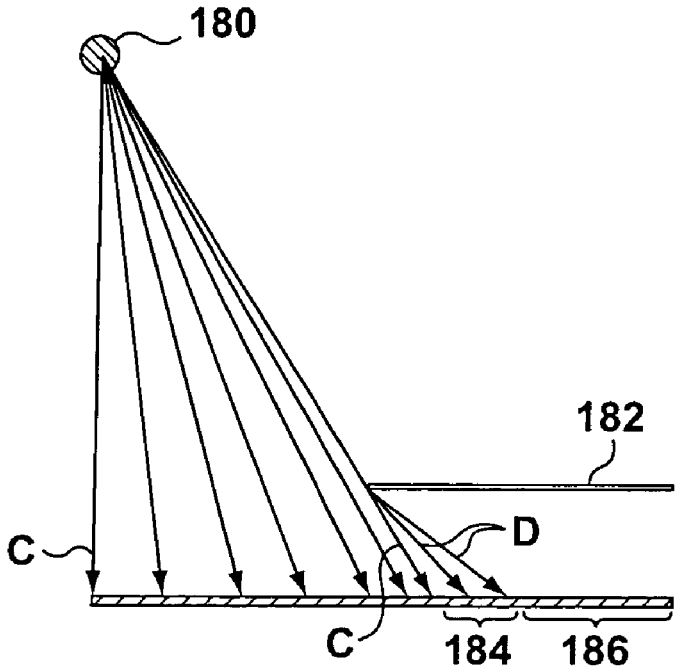
FIG. 9 is a cross section of the screen, the mask element, and the source of FIG. 8 taken along line 8—8 in FIG. 7.

The translucent portion 28 and the transition portion 32 on the front surface 12 of the screen 18 are preferably partially reflective, and are preferably created as follows. As shown in FIG. 7, a source 180 of vaporized metal (not shown) adapted for spraying vaporized metal onto the front surface 20 is provided. Also, a mask element 182 is provided, to substantially prevent vaporized metal sprayed from the source 180 from condensing on the transparent portion 32 of the front surface 20. The mask element 182 is positioned in a predetermined mask position relative to the source 180 and the front surface 20, as shown in FIGS. 7–9. The source 180 is also positioned in a predetermined source position relative to the mask element 182 and the front surface 20 so that vaporized metal is sprayable from the source 180 onto the translucent portion 28 and the transition portion 32 of the front surface 20.

The path of the vaporized metal sprayed from the source 180 onto the front surface 20 is schematically shown by arrows C and D in FIG. 9. The arrows identified as C in FIG. 9 represent metal vapor which is sprayed directly onto the front surface 20 to form the translucent portion 28. The arrows identified as D in FIG. 9 represent the metal vapor which is distributed over a portion of the front surface 20 to form the transition portion 32. As can be seen in FIG. 9, the transition portion 32 is in an area 184 on which vaporized metal condenses, spread out so that its concentration is not as great as in the translucent portion because the mask element 182 prevents spraying of the vaporized metal directly onto the area 184. As can be seen in FIG. 9, the mask element 182 also prevents vaporized metal from condensing in the transparent portion 30, formed in an area 186.

Preferably, the screen 18, 118 comprises glass. Alternatively, a suitable polycarbonate (such as plexiglas) or a suitable acrylic material can be used.

The vaporized metal is preferably produced by passing a relatively high electric current through a suitably prepared metal, such as aluminium. As is known in the art, the high current vaporizes the metal, i.e., changes the metal so that it is in a gaseous state. The vaporized metal can then be sprayed onto a surface which is at a lower temperature (e.g., the surface 20, at room temperature), causing the rapid "condensation" (i.e., solidification) of the vaporized metal on the cooler surface.

Alternatively, some or all of the viewing region 28 can be formed using silvered film, attached to the front surface by any suitable means. For example, where the viewing region includes silvered film, the transition region could be formed by spraying suitable materials onto the front surface. Alternatively, both the viewing region 28 and the transition region 32 could be formed using silvered film.

It will be evident to those skilled in the art that the invention can take many forms, and that such forms are within the scope of the invention as claimed. Therefore, the spirit and scope of the appended claims should not be limited to the descriptions of the versions contained herein.

We claim:

1. A flame simulating assembly for providing at least one image of flames, the flame simulating assembly comprising:

a simulated fuel bed;

at least one light source for producing said at least one image of flames;

a screen positioned behind the simulated fuel bed, the screen comprising a front surface adjacent to the simulated fuel bed;

the screen being positioned in a path of light from said at least one light source and adapted to transmit said at least one image of flames through the screen;

at least one simulated interior fireplace wall positioned behind the screen;

the front surface of the screen comprising:

a viewing region disposed proximate to the simulated fuel bed, said at least one image of flames being transmittable through the viewing region; and an observation region disposed distal to the simulated fuel bed, the observation region being adapted to permit observation of at least part of said at least one simulated interior fireplace wall through the observation region.

2. A flame simulating assembly according to claim 1 additionally comprising a transition region disposed between the observation region and the viewing region, said at least one simulated interior fireplace wall being at least partially observable through the transition region, and said at least one image of flames being at least partially transmittable through the transition region.

3. A flame simulating assembly according to claim 1 in which the screen additionally comprises a back surface located behind the front surface, the back surface being adapted to diffuse light transmitted therethrough.

4. A flame simulating assembly according to claim 1 which said at least one simulated interior fireplace wall has a pattern simulating firebrick thereon.

5. A flame simulating assembly according to claim 4 additionally comprising a housing, said at least one simulated interior fireplace wall being mounted on a back wall of the housing.

6. A flame simulating assembly according to claim 5 in which the housing comprises at least two simulated interior fireplace side walls, each of said at least two simulated interior fireplace side walls extending forwardly from said back wall.

7. A flame simulating assembly according to claim 6 in which said at least two simulated interior fireplace side walls extend forwardly from said back wall beyond the front surface of the screen.

8. A flame simulating assembly according to claim 7 in which said at least two simulated interior fireplace side walls comprise patterns simulating firebrick thereon, said patterns being configured to mate with the firebrick pattern on said at least one simulated interior fireplace wall.

9. A flame simulating assembly according to claim 1 comprising a flame effect element for configuring light from said at least one light source to form said at least one image of flames, the flame effect element being positioned in the path of light between said at least one light source and the screen.

10. A flame simulating assembly according to claim 1 comprising a flicker element for causing light from said at least one light source to fluctuate to form said at least one image of flames, the flicker element being positioned in the path of light between said at least one light source and the screen.

11. A flame simulating assembly for providing at least one image of flames, the flame simulating assembly comprising:

a simulated fuel bed;

a screen positioned behind the simulated fuel bed, the screen comprising a front surface adjacent to the simulated fuel bed and being adapted for transmission of said at least one image of flames therethrough;

at least one simulated interior fireplace wall positioned behind the screen;

at least one light source for producing said at least one image of flames;

a flicker element positioned in a path of light between said at least one light source and the screen for causing light from said at least one light source to fluctuate;

the screen being positioned in a path of fluctuating light from said at least one light source, such that said at least one image of flames is transmittable therethrough;

the front surface including:

a viewing region disposed proximate to the simulated fuel bed, said at least one image of flames being transmittable through the viewing region; and an observation region disposed distal to the simulated fuel bed, the observation region being adapted to permit observation of at least part of said at least one simulated interior fireplace wall through the observation region.

12. A flame simulating assembly according to claim 11 additionally comprising a transition region disposed between the observation region and the viewing region, said at least one simulated interior fireplace wall being at least partially observable through the transition region, and said at least one image of flames being at least partially transmittable through the transition region.

13. A flame simulating assembly according to claim 11 in which said at least one interior fireplace wall has a firebrick pattern thereon.

14. A flame simulating assembly according to claim 11 in which the viewing region of the front surface of the screen at least partially reflects an image of the simulated fuel bed.

15. A flame simulating assembly according to claim 11 additionally comprising a flame effect element positioned in the path of fluctuating light between the flicker element and the screen, for configuring light from the light source to form the image of flames.

16. A flame simulating assembly comprising:

a housing with a back wall, a top wall attached to the back wall, a bottom wall positioned opposite the top wall, and at least two side walls extending between the top and bottom walls, defining a cavity opening to a front end of the housing;

at least one interior element positioned proximal to the back wall;

a simulated fuel bed disposed in the cavity proximal to the front end of the housing;

at least one light source for producing at least one image of flames;

a screen positioned between the simulated fuel bed and said at least one interior element, the screen comprising a front surface positioned adjacent to the simulated fuel bed;

the screen being positioned in a path of light from said at least one light source, such that said at least one image of flames is transmitted through the screen;

the front surface of the screen comprising:

a viewing region disposed proximate to the simulated fuel bed, for transmitting said at least one image of flames therethrough;

an observation region disposed distal to the simulated fuel bed, the observation region being adapted to permit observation of at least part of said at least one interior element through the observation region; and a transition region disposed between the viewing region and the observation region, said at least one interior element being at least partially observable through the transition region, and said at least one image of flames being partially transmittable though the transition region.

17. A flame simulating assembly according to claim 16 in which said at least one interior element is a simulated interior fireplace wall.

18. A flame simulating assembly according to claim 17 in which the simulated interior fireplace wall includes a firebrick pattern thereon.

19. A flame simulating assembly according to claim 18 in which the housing comprises at least two simulated interior side walls, each of said at least two simulated interior side walls extending forwardly from the simulated interior fireplace wall.

20. A flame simulating assembly according to claim 19 in which said at least two simulated interior side walls comprise patterns simulating firebrick thereon, said patterns being configured to align with the firebrick pattern on the simulated interior fireplace wall.

21. A flame simulating assembly according to claim 16 comprising a flame effect element for configuring light from said at least one light source to form said at least one image of flames, the flame effect element being positioned in the path of light between said at least one light source and the screen.

22. A flame simulating assembly according to claim 16 comprising a flicker element for causing light from said at least one light source to fluctuate, the flicker element being positioned in the path of light between said at least one light source and the screen.

23. A flame simulating assembly according to claim 16 comprising a shield for obstructing light from said at least one light source, the shield being positioned behind the screen and substantially below the observation region.

24. A flame simulating assembly for providing at least one image of flames, the flame simulating assembly comprising:

a simulated fuel bed;

a screen positioned behind the simulated fuel bed, the screen comprising a front surface adjacent to the simulated fuel bed;

at least one light source for producing said at least one image of flames;

a flicker element positioned under the simulated fuel bed, the flicker element being positioned in a path of light between said at least one light source and the screen, for causing light from said at least one light source to fluctuate;

at least one simulated interior fireplace wall positioned behind the screen;

the front surface of the screen comprising:

a viewing region disposed proximate to the simulated fuel bed, the viewing region being adapted for transmission of said at least one image of flames therethrough; and an observation region disposed distal to the simulated fuel bed, the observation region being adapted to permit observation of at least part of said at least one simulated interior fireplace wall therethrough.

25. A flame simulating assembly according to claim 24 in which the front surface of the screen additionally comprises:

a transition region disposed between the viewing region and the observation region;

said at least one image of flames being transmittable through the transition region; and said at least one simulated interior fireplace wall being at least partially observable through the observation region.

26. A flame simulating assembly according to claim 24 additionally comprising a flame effect element for configuring light from said at least one light source to produce said at least one image of flames, the flame effect element being positioned in the path of light between the flicker element and the screen.

27. A flame simulating assembly for providing at least one image of flames, the flame simulating assembly comprising:

a simulated fuel bed;

at least one light source for producing said at least one image of flames;

a screen positioned behind the simulated fuel bed, the screen comprising a front surface adjacent to the simulated fuel bed;

the screen being positioned in a path of light from said at least one light source, and adapted to transmit said at least one image of flames through the screen;

at least one simulated interior fireplace wall positioned behind the screen;

the front surface of the screen comprising:

a viewing region disposed proximate to the simulated fuel bed, said at least one image of flames being transmittable through the viewing region;

an observation region disposed distal to the simulated fuel bed, the observation region being adapted to permit observation of at least part of said at least one simulated interior fireplace wall through the observation region;

a transition region disposed between the viewing region and the observation region, said at least one simulated interior fireplace wall being at least partially observable through the transition region, and said at least one image of flames being partially transmittable through the transition region;

the viewing region, the transition region and the observation region being produced by the steps of:

providing a source of vaporized metal adapted for spraying vaporized metal onto the front surface;

providing a mask element configured to substantially block vaporized metal sprayed from the source from condensing upon the observation region of the front surface;

positioning the mask element in a predetermined mask position relative to the source and the front surface of the screen;

positioning the source in a predetermined source position relative to the mask clement and the front surface, such that vaporized metal is sprayable from the source onto the viewing region and the transition region of the front surface;

spraying vaporized metal from the source onto the front surface; and permitting the metal sprayed onto the front surface to condense thereon.

28. A screen for use in a flame simulating assembly for providing an image of flames, the flame simulating assembly including a simulated fuel bed, at least one light source for producing the image of flames, and at least one simulated interior fireplace wall positioned behind the screen, the screen being positionable in a path of light from said at least one light source such that the image of flames is transmittable through the screen, the screen comprising:

a front surface positionable adjacent to the simulated fuel bed, when the screen is located behind the simulated fuel bed in the flame simulating assembly;

the front surface of the screen comprising:

a viewing region positionable proximate to the simulated fuel bed upon locating the screen is located behind the simulated fuel bed, the image of flames being transmittable through the viewing region;

an observation region positionable distal to the simulated fuel bed, the observation region being adapted to permit observation of at least part of said at least one simulated interior fireplace wall though the observation region;

a transition region disposed between the viewing region and the observation region, said at least one simulated interior fireplace wall being at least partially observable through the transition region, and the image of flames being partially transmittable through the transition region;

the viewing region and the transition region of the front surface of the screen being produced by the steps of:

providing a source of vaporized metal adapted for spraying vaporized metal onto the front surface;

providing a mask element configured to substantially block vaporized metal sprayed from the source from condensing upon the observation region of the front surface;

positioning the mask element in a predetermined mask position relative to the source and the front surface of the screen;

positioning the source in a predetermined source position relative to the mask element and the front surface, such that vaporized metal is sprayable from the source onto the viewing region and the transition region of the front surface;

spraying vaporized metal from the source onto the front surface; and permitting the metal sprayed onto the front surface to condense thereon in the viewing and transition regions.

* * * * *